United States Patent [19]

Fumia

[11] Patent Number: 4,858,761

[45] Date of Patent: Aug. 22, 1989

[54] BAG, PARTICULARLY A GOLF BAG, OF VARIABLE CONFIGURATION

[75] Inventor: Enrico Fumia, Turin, Italy

[73] Assignee: Pininfarina Extra S.r.l., Turin, Italy

[21] Appl. No.: 206,773

[22] Filed: Jun. 15, 1988

[30] Foreign Application Priority Data

Jun. 15, 1987 [IT] Italy ..... 53423/87[U]

[51] Int. Cl.[4] ..... A63B 55/00

[52] U.S. Cl. ..... 206/315.3; 206/315.4; 206/315.5; 206/315.6

[58] Field of Search ..... 206/315.2–315.9; 211/70.2; 248/96; 190/102

[56] References Cited

U.S. PATENT DOCUMENTS

| | | | |
|---|---|---|---|
| D. 172,785 | 8/1954 | Eging | 206/315.3 X |
| 451,843 | 5/1891 | Powell | 190/102 |
| 1,597,870 | 8/1926 | Reach | 206/315.6 |
| 1,637,538 | 8/1927 | Sampson | 206/315.2 |
| 1,920,308 | 8/1933 | Hiles | 206/315.6 |
| 2,047,079 | 7/1936 | MacMurray | 206/315.6 X |
| 2,070,254 | 2/1937 | Burgner | 248/96 X |
| 2,837,346 | 6/1958 | Chambless | 206/315.5 X |
| 3,530,919 | 9/1970 | May | 206/315.5 X |
| 4,350,194 | 9/1982 | Brown | 206/315.5 |
| 4,522,300 | 6/1985 | Hamblft | 206/315.4 |

FOREIGN PATENT DOCUMENTS

| | | | |
|---|---|---|---|
| 1292249 | 3/1962 | France | 206/315.3 |

*Primary Examiner*—Sue A. Weaver

*Attorney, Agent, or Firm*—Sughrue, Mion, Zinn, Macpeak & Seas

[57] ABSTRACT

A golf bag of variable configuration includes a tubular pillar to which are hinged two compartments each having a triangular cross-section. The compartments extend parallel to the tubular pillar and are open at one end. The two compartments are movable angularly between an open position in which they are spaced from each other and define with the tubular pillar a longitudinal outwardly-open V-shaped seat and a closed position in which they are side by side. An auxiliary container having a shape substantially complementary to that of the longitudinal seat can be fitted removably into the seat when the two compartments are in the open condition.

13 Claims, 4 Drawing Sheets

5
5a
5b
11
4
6
7

BAG, PARTICULARLY A GOLF BAG, OF VARIABLE CONFIGURATION

BACKGROUND OF THE INVENTION

The present invention relates to bags and suitcases in general, and more particularly to a golf bag. Conventionally, bags of this type are constituted by rigid or semi-rigid containers which are fairly voluminous and are provided with club-carrying compartments, as well as with further integral accessory-carrying compartments or pockets, and are intended to be fixed to a transporting trolley, or alternatively by smaller flexible bags with a shoulder-strap, intended to be carried on the shoulder of the player. In general, the bags of the first type are not suitable for carrying on the shoulder due to their bulk, whilst those of the second type cannot easily be adapted to transporting trolleys. Furthermore, these bags normally have irregular shapes, often with bulky bulging portions, and are thus inconvenient in use and difficult to place when not in use.

Similar problems also occur in the case of travelling bags and suitcases in general, whose shapes and dimensions are not easily adaptable to different requirements of use.

SUMMARY OF THE INVENTION

The object of the present invention is to avoid the above problems and to produce a bag, particularly but not exclusively a golf bag, which has a regular shape and whose dimensions, and consequently the internal space available, can be of a modular nature and easily adaptable to different requirements of use.

A further object of the invention is to produce a practical, convenient and functional bag of simple construction, which can be produced relatively cheaply.

Another object of the invention is to produce a bag which is formed in such a way as to rationalise to the utmost the use made of the internal space, with a geometrically basic and simple volume.

In order to achieve these objects, the subject of the invention is a bag, particularly but not exclusively a golf bag, characterised in that it comprises a tubular pillar to which are hinged two compartments which extend parallel to the tubular pillar and are open at one end, the compartments being movable angularly between an open position in which they are spaced from each other and define with the tubular pillar a longitudinal seat which is open outwardly along one side of the bag, and a closed position in which they are side by side, and an auxiliary container which has a shape substantially complementary to that of the longitudinal seat and can be fitted removably into the seat when the two compartments are in the open condition.

The tubular pillar, which normally has a rigid structure, has a multi-use carrying function (attachment of carrying handle, attachment of shoulder-strap; attachment and hinging of the auxiliary container; umbrella-holder).

The two compartments are normally formed by spaced pairs of annular elements projecting transversely from the tubular pillar and connected rotatably thereto. The homologous annular elements of the two pairs are interconnected by respective rods parallel to the tubular pillar and carry respective casings which are closed at the ends opposite the open ends of the two compartments by means of respective rigid base covers. By the rotation of the two compartments, the bag can assume different configurations corresponding to variations of the space intended to receive the contents. In particular, when the bag is to be used as a golf bag, the two compartments are intended to contain the clubs. When the two compartments are in the open condition, the longitudinal seat defined thereby houses the auxiliary container which can be used as an accessory-carrying bag. In this configuration, the bag may easily be fixed to a transporting trolley usually used for golfing.

When the contents of the auxiliary bag are not required during play, this bag may be removed and separated from the bag so as to enable the two compartments to be placed side-by-side to obtain the least bulky configuration of the bag, enabling it to be carried comfortably on the shoulder of the user. In practice, upon changing from the most bulky configuration to the least bulky, the available carrying space is substantially halved.

In the particular case of a golf bag, the accessories which complete the equipment of the bag are the carrying handle, the attachments and the shoulder-strap, the rain hood (which can be fitted to the open ends of the receptacles and is in turn detachable from the assembly and can even be folded between the two club-carrying compartments and the accessory-carrying bag when it is not in use), any pockets formed on the outside of the club-carrying compartments for carrying items which are not bulky (score-cards, tees, markers, gloves, etc.). The umbrella-holder, however, is defined by the tubular pillar, as stated.

Structurally, there are no limits to the type of material which can be used for the various components, in that the club-carrying compartments and the accessory-carrying bag can be made equally well with soft walls (artificial leather, leather; textile) or with rigid walls (laminated resin, plastics material; metal; cellulose compounds, etc.) The same is true of the tubular pillar and the other components of the carrying structure of the case (the annular elements and their interconnecting rods). The rigidity necessary for the stress points intended to support the loads or to provide the force required may be achieved by local reinforcement or reinforcement of the whole length.

The general geometrical shape of the bag can vary, the characteristic of a regular volume remaining the same. According to a preferred embodiment, the bag is parallelepipedal in shape with a section which is rectangular in the open condition of the two compartments and square in the closed condition thereof. In this case, the two compartments have a cross-sectional profile which is essentially like a right-angled isosceles triangle, and the auxiliary bag has an isosceles triangular profile. Alternatively, the two components may have quadrangular sections (parallelepipedal or trapezoidal) or may be polygonal, semicircular, lobe-shaped, or even flattened and elongate in shape.

Although the use of the bag according to the invention as a golf bag is particularly advantageous, different uses, such as a travelling bag or suitcase, can be considered just as convenient.

BRIEF DESCRIPTION OF THE DRAWINGS

The invention will now be described in detail with reference to the appended drawings, provided purely by way of non-limiting example, in which.

DETAILED DESCRIPTION OF THE INVENTION

Figure 2:
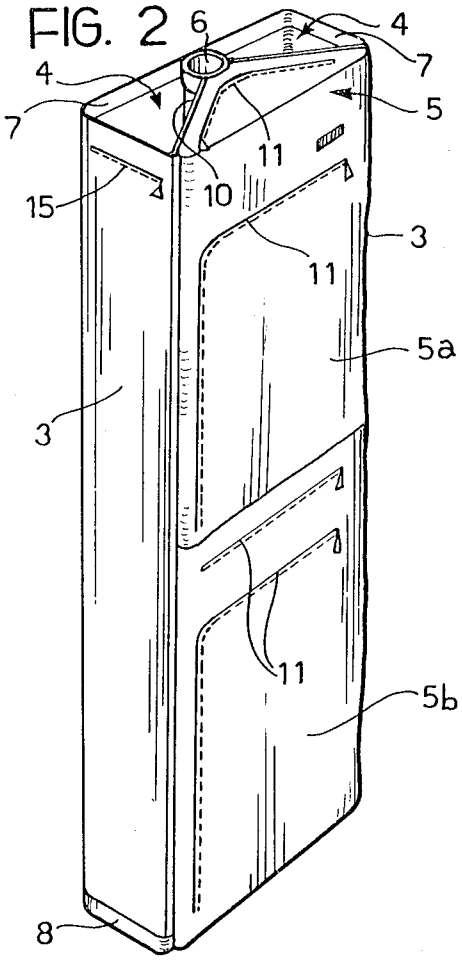
FIG. 2 is a perspective view of the bag from the back.
Figure 1:
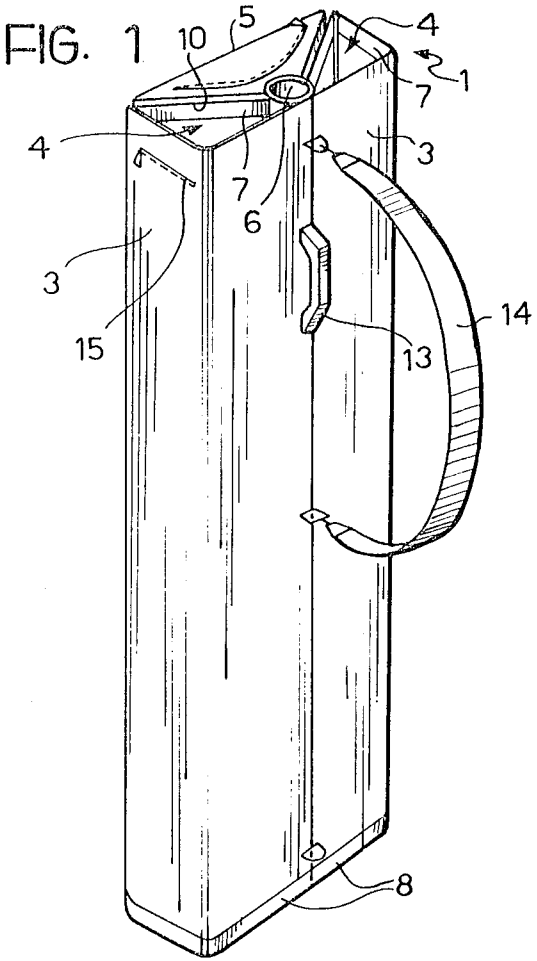
FIG. 1 is a schematic perspective frontal view of a golf bag according to the invention.

With reference initially to FIGS. 1 and 2, a bag according to the invention is generally indicated 1 and can be used, for example, as a golf bag. The bag 1 comprises essentially a carrying structure 2, illustrated in greater detail in FIGS. 3 to 7, two casings 3 fitted to the carrying structure 2 in the manner explained below and defining therewith two club-carrying compartments 4 which are side by side, and an auxiliary container 5 which can be fitted selectively to the carrying structure 2 in the manner made clear below.

Figure 3:
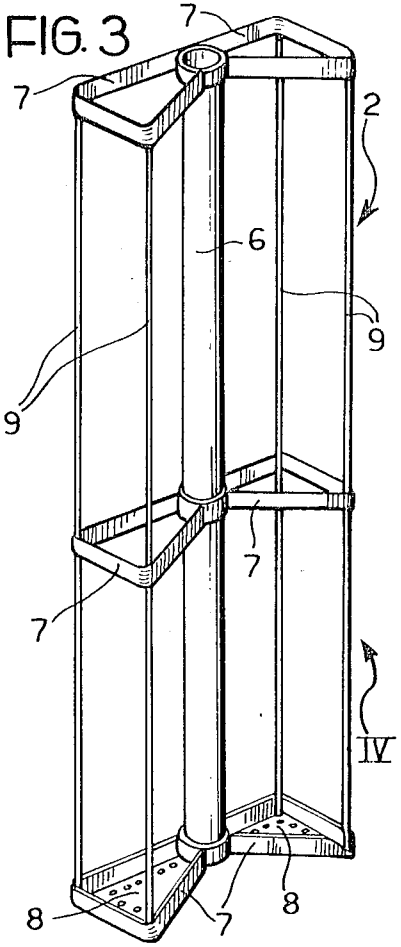
FIG. 3 is a perspective view which shows the carrying structure of the bag.
Figure 4:
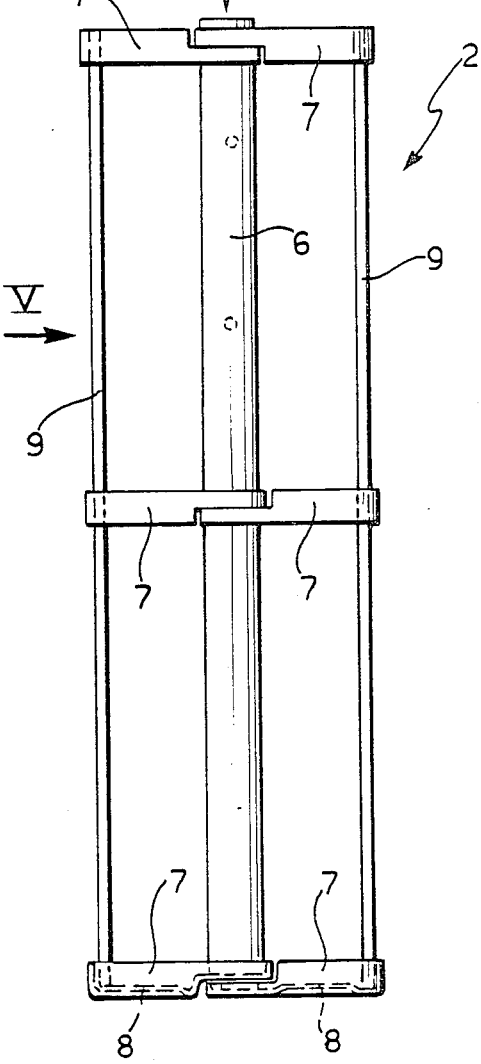
FIG. 4 is a front elevational view taken on the arrow IV of FIG. 3.
Figure 5:
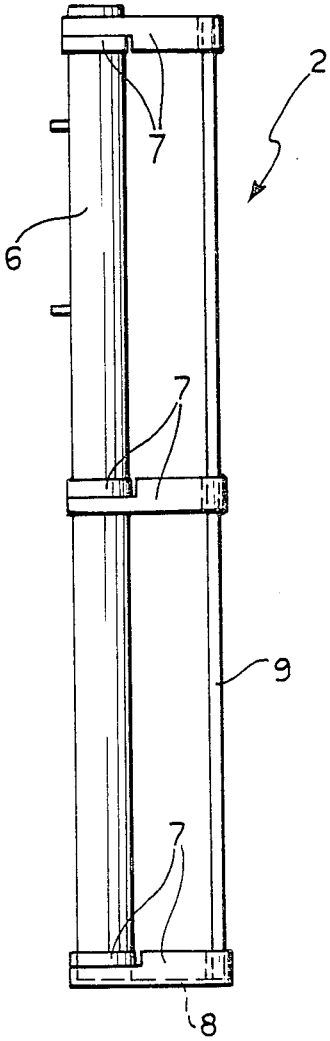
FIG. 5 is a side elevational view taken on the arrow V of FIG. 4.

With reference in greater detail to FIGS. 3 to 5, the carrying structure 2 comprises essentially an axially elongate, rigid tubular pillar 6 having dimensions of length and width such as to accommodate a closed umbrella.

At the top, at the base and in the middle region of the tubular pillar 6 are fitted three pairs of annular elements 7, of which the lower ones are closed by means of respective rigid base covers 8 which are conveniently perforated.

According to the preferred embodiment of the bag, the annular elements 7 have a cross-sectional profile which is substantially triangular with rounded corners, conveniently a right-angled isosceles triangle. The annular elements 7 of each pair are articulated to each other and to the tubular pillar 6 in the manner clearly illustrated in FIGS. 4 and 5, and the homologous annular elements 7 of the two pairs are rigidly interconnected by respective rods 9 parallel to the tubular pillar 6.

The casings 3 are tubular in shape and are fixed independently of each other to the homologous annular elements 7 of the two pairs. In this way, each of the two compartments 4 is defined in practice by the tubular pillar 6 and the three annular elements 7 situated on the same side, with their connection rods 9, and by the corresponding casing 3 which is closed at the bottom by its respective base cover 8 and is open at the top.

It should be noted that, although in the case of the illustrated example, the carrying structure 2 is rigid and the casings 3 are flexible, a solution is also envisaged in which the tubular pillar 6 is flexible but the casings 3 are rigid. In this case, the interconnecting rods 9 between the annular elements 7 may be omitted.

Figure 6:
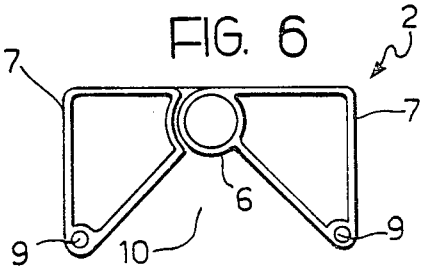
FIG. 6 is a plan view from above taken on the arrow VI of FIG. 4 in the open configuration of the carrying structure.
Figure 7:
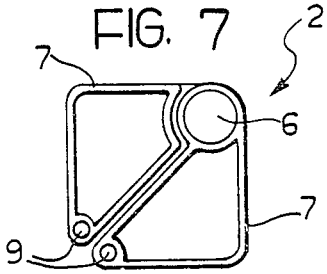
FIG. 7 is a view similar to FIG. 6 in the closed configuration of the structure.
Figure 8:
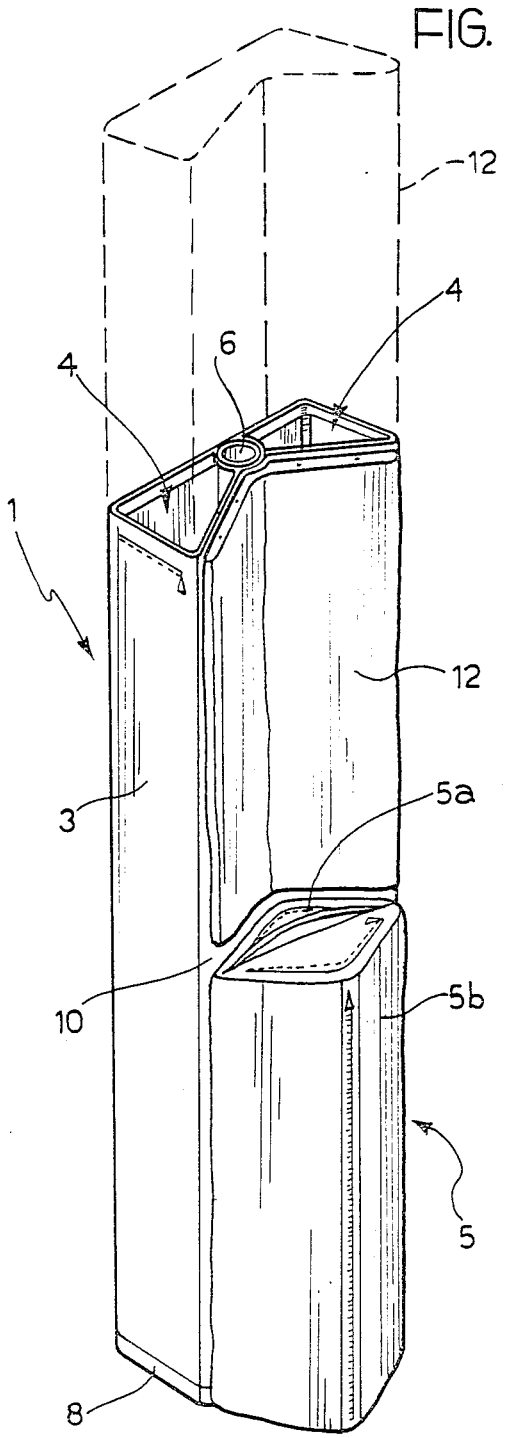
FIG. 8 is a view similar to FIG. 2, showing the bag in a first possible alternative configuration.

By virtue of the articulated connection illustrated, the annular elements 7 can rotate like compasses between a spaced-apart open position, illustrated in FIG. 6, in which the catheti of the elements 7 are parallel to each other, and a side-by-side closed position, illustrated in FIG. 7, in which the hypotenuses of the elements 7 are next to each other. Identical configurations are obviously assumed by the two compartments 2, as illustrated in FIGS. 1, 2 and 8 and in FIG. 9, respectively.

In the first configuration, that is, the open one, the two compartments 4 define, between the hypotenuses of the annular elements 7 and the tubular pillar 6, a substantially V-shaped longitudinal seat 10 which is open outwardly along one side of the bag 1. With the two compartments 4 in the side-by-side configuration illustrated in FIG. 9, this seat 10 is eliminated so that the bag 1 has a substantially square shape in cross-section.

Figures 10, 11, 12, 13, 14, 15, 16, 17, 18:
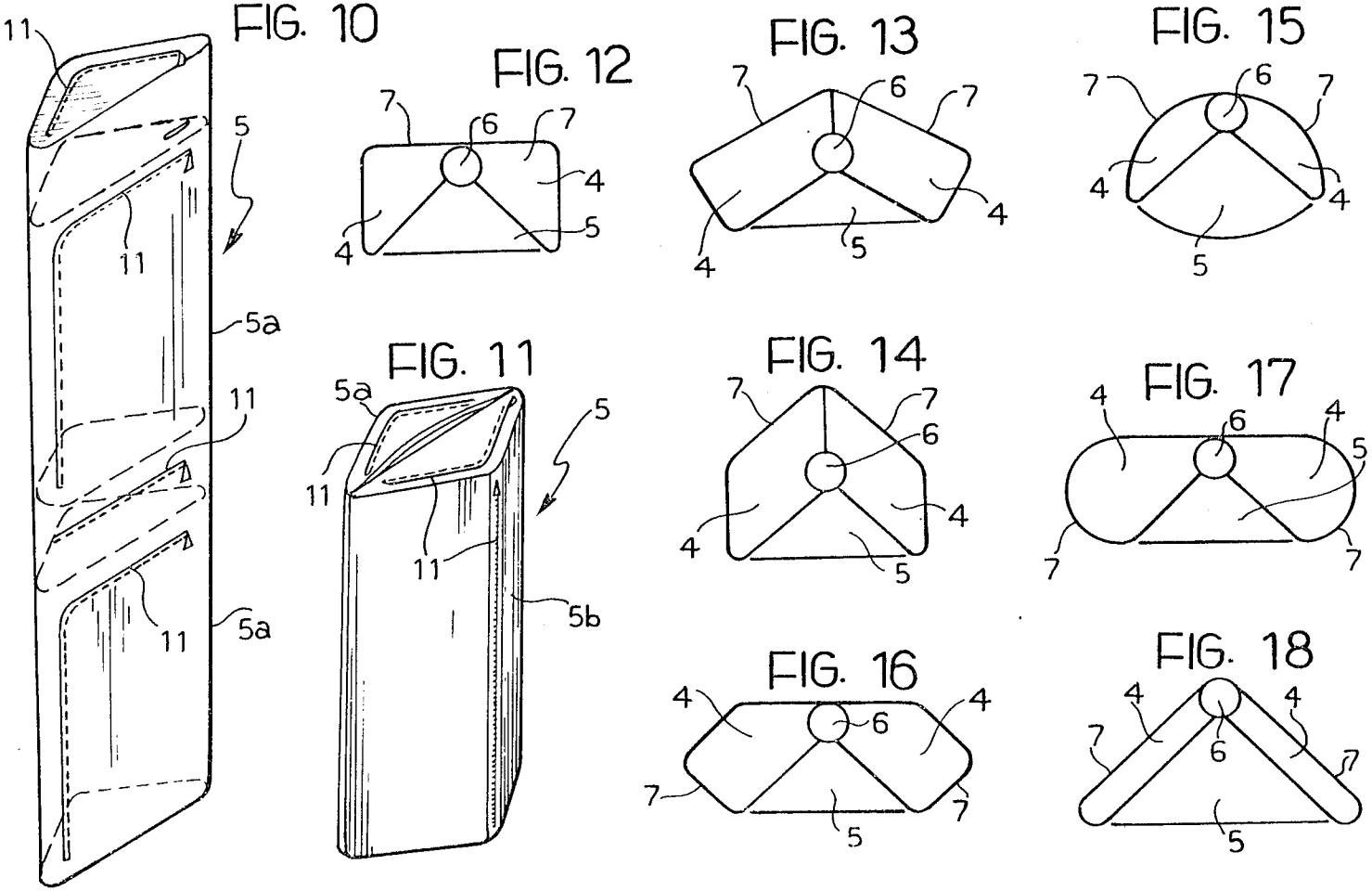
FIG. 10 is a perspective view of the auxiliary container of the bag in a first possible configuration.
FIG. 11 is a view similar to FIG. 10 with the auxiliary container in a second possible configuration.
FIG. 12 is a schematic plan view of the bag configuration as shown in FIG. 1.
FIG. 13 is a schematic plan view of a first modified bag configuration.
FIG. 14 is a schematic plan view of a second modified bag configuration.
FIG. 15 is a schematic plan view of a third modified bag configuration.
FIG. 16 is a schematic plan view of a fourth modified bag configuration.
FIG. 17 is a schematic plan view of a fifth modified bag configuration.
FIG. 18 is a schematic plan view of a sixth modified bag configuration.

The longitudinal seat 10 is adapted to house the auxiliary container 5, in the manner illustrated in FIGS. 1 and 2. As can better be seen in FIGS. 10 and 11, this auxiliary container 5 is conveniently constituted by a flexible bag of triangular section, having a length corresponding to that of the tubular pillar 6 and provided with pockets 11 with zip fasteners. This bag 5 is conveniently divided into two longitudinal sections 5*a*, 5*b* of equal length which can be kept one as an extension of the other, as illustrated in FIG. 10, or folded one against the other, as illustrated in FIG. 1.

This bag 5 is provided with rapid connection means, not illustrated, constituted, for example, by press-studs, zip fasteners, or similar means, for its separable connection to the tubular pillar 6 and/or the outside of the two compartments 4. These connection means enable it to be fixed both in the extended configuration of FIG. 10 (FIGS. 1 and 2) and in the folded configuration of FIG. 11, as illustrated in FIG. 8. The second case allows access to a rain hood 12, normally folded into the upper region of the seat 10, which can be fitted by rapid connection means (studs, zip fasteners, or the like) to the tops of the two compartments 4, as indicated with a broken line in FIG. 8.

The bag is completed by various accessories, such as a carrying handle 13, a shoulder-strap 14 and any other attachments fixed to the tubular pillar 6, and by further pockets 15 formed in the casings 3 and adapted to contain small items.

In the complete configuration of FIGS. 1 and 2, the bag 1 formed by the two compartments 4 and by the auxiliary container 5 has a generally rectangular cross-sectional shape. In this configuration, which is the one with the maximum useful volume, the bag 1 may easily be fixed to a normal transporting trolley usually used for golfing. The compartments 4 are adapted to house the golf clubs, whilst the tubular pillar 6 can house an umbrella. The auxiliary container 5 can house any additional bulky equipment, such as shoes, articles of clothing, etc., whilst the pockets 15 of the casing 3 can contain small items used frequently during play.

Figure 9:
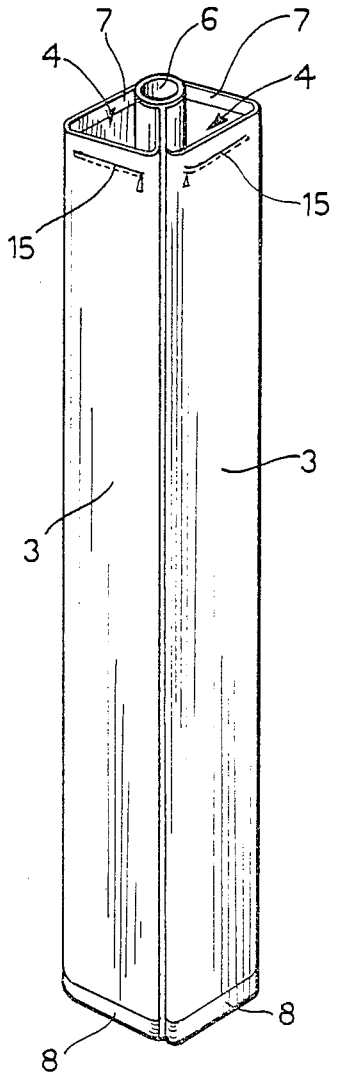
FIG. 9 is a perspective view which shows the bag in a second possible alternative configuration.

When the accessories in the container 5 are not required during play and the player has to carry the bag 1 by the shoulder-strap, the container 5 is removed by simple and rapid operations and the two club-carrying compartments 4 brought alongside each other to obtain the least bulky configuration of FIG. 9. In this case, the auxiliary container can be folded into the configuration of FIG. 11 and perhaps carried separately.

FIGS. 12 to 18 illustrate possible variants of the sectional shape of the bag 1 corresponding to different profiles of the annular elements 7 articulated to the tubular pillar 6.

FIG. 12 corresponds to the preferred embodiment described above, in which the annular elements 7 and therefore the two compartments 4 have a right-angled isosceles triangular section.

In the case of FIGS. 13 and 14, the two compartments 4 have quadrangular, trapezoidal and parallelogram shapes respectively.

In the case of FIG. 15, the two compartments 4 are substantially semi-circular and, in this case, the auxiliary container 5 may conveniently have the shape of a circular sector.

FIG. 16 shows an irregular polygonal configuration of the two compartments 4 and FIG. 17 shows a lobe-shaped configuration thereof.

Finally, in the case of FIG. 18, the two compartments 4 have a flattened, elongate profile.

Naturally, further alternative geometric configurations are possible.

Furthermore, although specific reference has been made to the use of the bag according to the invention as a golf bag in the example illustrated, it is clear that the same utility and advantages of the invention also extend to different uses of the bag, for example, to its use as a travelling bag or suitcase.

I claim:

1. A golf bag of variable configuration comprising a tubular pillar, two compartments disposed parallel to said pillar; hinge means connecting said compartments to the pillar, the compartments being open at one end and being movable angularly between an open position in which they are spaced from each other and define with the tubular pillar a longitudinal seat which is open outwardly along one side of the bag, and a closed position in which they are side by side, and an auxiliary container which has a shape substantially complementary to that of the longitudinal seat and can be fitted removably into the seat when the two compartments are in the open condition, wherein the longitudinal seat defined in the open position of the two compartments has a V-shaped section, and the auxiliary container has a substantially triangular cross-sectional profile.

2. A bag according to claim 1, wherein the auxiliary container is in the form of a flexible bag having a length equal to that of the longitudinal seat and formed by two longitudinal portions which can be folded one against the other.

3. A bag according to claim 1, wherein the compartments have substantially triangular cross-sectional profiles, and the bag has a generally quadrangular cross-sectional profile both when the two compartments are in the open condition with the auxiliary container inserted in the longitudinal seat and when they are in the closed condition.

4. A bag according to claim 5, wherein the compartments have substantially quadrangular cross-sections.

5. A bag according to claim 4, wherein the compartments have parallelogram-shaped cross-sections.

6. A bag according to claim 4, wherein the compartments have substantially trapezoidal cross-sections.

7. A bag according to claim 1, wherein the compartments have polygonal cross-sections.

8. A bag according to claim 1, wherein the compartments have semi-circular cross-sections.

9. A bag according to claim 1, wherein the compartments have lobe-shaped sections.

10. A bag according to claim 1, wherein the compartments have flattened and elongate cross-sectional profiles.

11. A bag according to claim 1, wherein the tubular pillar has dimensions such as to accommodate a closed umbrella.

12. A bag according to claim 1, wherein it includes a carrying handle and a shoulder-strap which are fixed to the tubular pillar on the opposite side to the longitudinal seat.

13. A bag according to claim 1, wherein a rain hood is housed removably in the longitudinal seat and can be fitted to the open ends of the two compartments.

* * * * *